US011810418B2

(12) United States Patent
Sensui et al.

(10) Patent No.: US 11,810,418 B2
(45) Date of Patent: Nov. 7, 2023

(54) COMPUTER-READABLE NON-TRANSITORY STORAGE MEDIUM HAVING INFORMATION PROCESSING PROGRAM STORED THEREIN, INFORMATION PROCESSING SYSTEM, INFORMATION PROCESSING METHOD, AND INFORMATION PROCESSING APPARATUS

(71) Applicant: NINTENDO CO., LTD., Kyoto (JP)

(72) Inventors: Kazuyoshi Sensui, Kyoto (JP); Masaki Yasuhara, Kyoto (JP)

(73) Assignee: Nintendo Co., Ltd., Kyoto (JP)

( * ) Notice: Subject to any disclaimer, the term of this patent is extended or adjusted under 35 U.S.C. 154(b) by 60 days.

(21) Appl. No.: 17/749,326

(22) Filed: May 20, 2022

(65) Prior Publication Data

US 2023/0017283 A1 Jan. 19, 2023

(30) Foreign Application Priority Data

Jul. 16, 2021 (JP) ..... 2021-117932

(51) Int. Cl.
*G07F 17/32* (2006.01)

(52) U.S. Cl.
CPC ..... *G07F 17/329* (2013.01); *G07F 17/3209* (2013.01); *G07F 17/3211* (2013.01)

(58) Field of Classification Search
CPC ..... G07F 17/329; G07F 17/3209; G07F 17/3211; G07F 17/32
USPC ..... 463/17, 20
See application file for complete search history.

(56) References Cited

U.S. PATENT DOCUMENTS

| | | | | |
|---|---|---|---|---|
| 10,665,058 | B2 * | 5/2020 | Ito | G07F 17/3209 |
| 11,158,162 | B2 * | 10/2021 | Oberberger | G07F 17/3286 |
| 2013/0196732 | A1 * | 8/2013 | Oochi | A63F 13/69 463/17 |
| 2018/0085668 | A1 | 3/2018 | Matsushita et al. | |
| 2019/0043312 | A1 * | 2/2019 | Ito | G07F 17/3262 |
| 2019/0060763 | A1 | 2/2019 | Arai et al. | |
| 2019/0311578 | A1 | 10/2019 | Sensui et al. | |
| 2020/0242891 | A1 * | 7/2020 | Ito | G07F 17/3209 |

FOREIGN PATENT DOCUMENTS

| | | |
|---|---|---|
| JP | 2017-196116 | 11/2017 |
| JP | 2018-047100 | 3/2018 |
| JP | 2019-180784 | 10/2019 |
| JP | 2021-097921 | 7/2021 |

* cited by examiner

*Primary Examiner* — Pierre E Elisca
(74) *Attorney, Agent, or Firm* — Nixon & Vanderhye PC

(57) ABSTRACT

A lottery game is selected out of a plurality of lottery games in each of which a plurality of contents are set as a lottery target. A content is specified through a lottery out of the plurality of contents set as the lottery target in the selected lottery game. A lottery game is specified as a recommended lottery game on the basis of a predetermined condition out of lottery games that are different from the selected lottery game among the plurality of lottery games. In a lottery result display scene, a first image regarding the specified content and a second image regarding the specified recommended lottery game are displayed, and when a user operation on the second image has been performed, the lottery result display scene is caused to transition to a scene for the recommended lottery game regarding the second image.

14 Claims, 7 Drawing Sheets

101

| ITEM ID (201) | ITEM TYPE DATA (202) | ITEM CONTENT DATA (203) |
|---|---|---|
| 0100 | ··· | ··· |
| 0101 | ··· | ··· |
| 0102 | ··· | ··· |
| ⋮ | ⋮ | ⋮ |

FIG.7

102

| 211 LOTTERY GAME ID | 212 LOTTERY GAME TYPE DATA | 213 SELLING PERIOD DATA | 214 LOTTERY TARGET ITEM DATA | 215 COMPLETION FLAG DATA | 216 RECOMMENDATION TAG DATA |
|---|---|---|---|---|---|
| 1000 | ... | ... | ... | ... | ... |
| 1001 | ... | ... | ... | ... | ... |
| 1002 | ... | ... | ... | ... | ... |
| ... | ... | ... | ... | ... | ... |

| |
|---|
| CHRISTMAS |
| PLEASANT |
| BEAUTIFUL |
| WINTER |
| FAMILY |
| ... |

COMPUTER-READABLE NON-TRANSITORY STORAGE MEDIUM HAVING INFORMATION PROCESSING PROGRAM STORED THEREIN, INFORMATION PROCESSING SYSTEM, INFORMATION PROCESSING METHOD, AND INFORMATION PROCESSING APPARATUS

CROSS REFERENCE TO RELATED APPLICATION

This application claims priority to Japanese patent application No. 2021-117932 filed on Jul. 16, 2021, the entire contents of which are incorporated herein by reference.

FIELD

The present disclosure relates to information processing such as a game in which a lottery game is performed.

BACKGROUND AND SUMMARY

To date, a game in which a lottery game is performed and a result of the lottery game is displayed has been known.

In the above game, there is room for improvement in that interest of a user in each of a plurality of lottery games is further enhanced.

Therefore, an object of the exemplary embodiment is to provide a computer-readable non-transitory storage medium having stored therein an information processing program that can enhance interest of a user in each of a plurality of lottery games, an information processing system, an information processing method, and an information processing apparatus.

Configuration examples for achieving the above objects will be shown below.

An example of configuration 1 is a computer-readable non-transitory storage medium having stored therein instructions that, when executed by a processor of an information processing apparatus, cause the information processing apparatus to: select, on the basis of a user operation, at least one lottery game out of a plurality of lottery games in each of which a plurality of contents are set as a lottery target; specify, on the basis of a lottery, at least one content out of the plurality of contents set as the lottery target in the selected lottery game; specify, as a recommended lottery game, a lottery game selected on the basis of a predetermined condition out of lottery games that are different from the selected lottery game among the plurality of lottery games; cause a display device to display, in a lottery result display scene, at least a first image regarding the specified content and a second image regarding the specified recommended lottery game; and cause, when a user operation on the second image has been performed in the lottery result display scene, the lottery result display scene to transition to a scene for the recommended lottery game regarding the second image.

According to the above configuration example, lottery games that are different from the lottery game selected by the user can be specified as a recommended lottery game, and a second image regarding the recommended lottery game can be displayed. Therefore, interest of the user in each of a plurality of lottery games can be enhanced.

In an example of configuration 2, in the example of the above configuration 1, at least one lottery game associated in advance with the selected lottery game may be specified as the recommended lottery game out of the lottery games that are different from the selected lottery game.

According to the above configuration example, a lottery game related to the lottery game selected by the user can be specified as the recommended lottery game. Therefore, interest of the user in each of the plurality of lottery games can be enhanced.

In an example of configuration 3, in the example of the above configuration 1, at least one lottery game associated in advance with the selected lottery game, and/or a lottery game not associated in advance with the selected lottery game may be specified, as the recommended lottery game, out of the lottery games that are different from the selected lottery game.

According to the above configuration example, a wide range of lottery games that are not related to the lottery game selected by the user can be specified as the recommended lottery game. Therefore, interest of the user in each of the plurality of lottery games can be enhanced.

In an example of configuration 4, in the example of the above configuration 2, each of the plurality of lottery games may have stored therein in advance at least one piece of tag information so as to correspond thereto, and at least one lottery game that has stored therein so as to correspond thereto tag information related to the tag information stored so as to correspond to the selected lottery game may be specified, as the recommended lottery game, out of the lottery games that are different from the selected lottery game.

According to the above configuration example, a lottery game is caused to be related on the basis of the relevance of the tag information caused to correspond to the lottery game. Therefore, in such a case where a lottery game has been added, deleted, or changed, relevance between lottery games can be easily managed.

In an example of configuration 5, in the example of the above configuration 4, when there are a plurality of lottery games that have stored therein so as to correspond thereto tag information related to the tag information stored so as to correspond to the selected lottery game, the recommended lottery game may be specified, on the basis of the number of pieces of the related tag information, out of said plurality of lottery games that have stored therein so as to correspond thereto tag information related to the tag information stored so as to correspond to the selected lottery game.

According to the above configuration example, it is possible to realize a wide range of relevance between the recommended lottery game to be specified and the lottery game selected by the user.

In an example of configuration 6, in the example of the above configuration 1, lottery games in a number determined on the basis of a condition different from the predetermined condition may be specified, as the recommended lottery game, out of the lottery games that are different from the selected lottery game among the plurality of lottery games.

According to the above configuration example, an appropriate number of lottery games can be recommended. Therefore, interest of the user in each of the plurality of lottery games can be appropriately enhanced.

In an example of configuration 7, in the example of the above configuration 6, lottery games in a number determined at least on the basis of the number of lottery games currently selectable by a user may be specified, as the recommended lottery game, out of the plurality of lottery games.

According to the above configuration example, an appropriate number of lottery games can be recommended on the basis of the number of lottery games selectable by the user. Therefore, interest of the user in each of the plurality of lottery games can be appropriately enhanced.

In an example of configuration 8, in the example of the above configuration 1, at least one lottery game may be selected on the basis of a user operation, out of a plurality of first lottery games each executable in exchange for consumption of a paid item and a plurality of second lottery games each executable without consumption of a paid item, and a lottery game selected on the basis of the predetermined condition may be specified, as the recommended lottery game, out of the plurality of first lottery games.

In an example of configuration 9, in the example of the above configuration 1, the display device may be caused to display the lottery result display scene that includes a third image, and when a user operation on the third image has been performed in the lottery result display scene, the lottery result display scene may be caused to transition to a scene for the selected lottery game.

According to the above configuration example, the scene transitions again to a scene for the lottery game executed this time. Therefore, while interest of the user in each of the plurality of lottery games is enhanced, interest of the user to the lottery game executed this time can be maintained.

In an example of configuration 10, in the example of the above configuration 1, a storage device may be caused to store a content possessed by a user, as a possessed content, and a lottery game in which all of a plurality of contents set as a lottery target are stored as the possessed content may be excluded from a target to be specified as the recommended lottery game.

According to the above configuration example, a lottery game in which all of contents are possessed by the user is not specified as the recommended lottery game. Therefore, interest of the user in each of the plurality of lottery games can be enhanced.

According to the exemplary embodiment, interest of the user in each of the plurality of lottery games can be enhanced.

These and other objects, features, aspects, and advantages of the exemplary embodiments will become more apparent from the following detailed description of non-limiting example embodiments when taken in conjunction with the accompanying drawings.

BRIEF DESCRIPTION OF THE DRAWINGS

FIG. 7 is a non-limiting example of data and the like stored in the memory 12 of the information processing apparatus 10;

DETAILED DESCRIPTION OF NON-LIMITING EXAMPLE EMBODIMENTS

Hereinafter, one exemplary embodiment will be described.

[Hardware Configuration of Information Processing Apparatus]

First, the configuration of an information processing apparatus according to the exemplary embodiment will be described. In the exemplary embodiment, an information processing apparatus 10 is assumed to be a smart device such as a smartphone or a tablet, a hand-held game apparatus, a portable laptop computer, or the like, for example. In the following description, an information processing apparatus (e.g., smartphone) having a display screen and a touch panel integrated with each other will be described as an example. Therefore, an input operation is mainly an input to the touch panel. However, in another exemplary embodiment, an input operation may be performed using a physical controller (e.g., a mouse) connected to the information processing apparatus wirelessly or via wire, or using an input device formed integrally with the information processing apparatus, for example.

Figure 1:
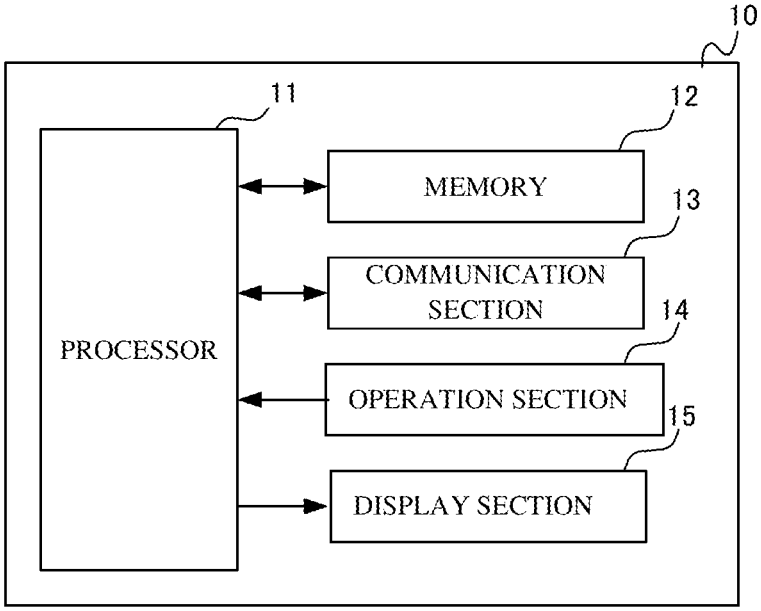
FIG. 1 is block diagram showing a non-limiting example of an information processing apparatus 10.

FIG. 1 is a function block diagram of the information processing apparatus 10 according to the exemplary embodiment. In FIG. 1, the information processing apparatus 10 includes a processor 11, a memory 12, a communication section 13, an operation section 14, and a display section 15. The processor 11 executes information processing as described later and executes a system program (not shown) for controlling overall operation of the information processing apparatus 10, thereby controlling operation of the information processing apparatus 10. The processor 11 may be a single processor or may be formed from a plurality of processors. The memory 12 stores various programs to be executed by the processor 11 and various data to be used for the various programs. The memory 12 is a flash EEPROM or a hard disk device, for example. The communication section 13 performs communication with a predetermined server via the Internet, or performs communication with another information processing apparatus 10 or the like. The operation section 14 is an input device for receiving an operation from a user, for example. The display section 15 is typically a liquid crystal display device. In the process according to the exemplary embodiment, a touch panel integrated with a liquid crystal screen is assumed as the operation section 14 and the display section 15. In another exemplary embodiment, a predetermined pointing device other than a touch panel may be used as the operation section 14.

[Outline of Information Processing (Game Process) in Exemplary Embodiment]

Next, the outline of information processing executed in the exemplary embodiment will be described. First, in the exemplary embodiment, an application process in which a predetermined content can be obtained through a "lottery" process is assumed. Specifically, as an example of the application, a process of a game application (which may be referred to as a "game process") is assumed. As an example of contents that can be obtained in a lottery, an "in-game content" that can be used in a game is assumed.

As the "in-game content", items such as characters, units, weapons, and protectors, abilities such as magic and skills, and the like that appear in the game are assumed, for example.

A game process assumed in the exemplary embodiment will be more specifically described. The game according to the exemplary embodiment is a game in which a user virtually lives as a player character in a virtual game world in which various virtual characters (resident characters) live. For example, the user can acquire various items to build his/her own house, can maintain his/her garden, or can have conversations with resident characters.

In the following description, as examples of the in-game contents, "items" such as furniture articles and small articles that can be arranged in the own house, garden, and the like are described.

Next, a method for obtaining an item will be specifically described. In the exemplary embodiment, the user can obtain (acquire) an item through a lottery. In addition, in the exemplary embodiment, the user can execute a "lottery game" in the game and obtain an item selected through a lottery performed as a result of execution of the lottery game.

In the game (which may be referred to as "this game") according to the exemplary embodiment, the user can execute the lottery game in a predetermined scene in the game. In this game, two types of methods are prepared as the execution method for the lottery game. Specifically, a method in which a virtual currency referred to as "first game currency" in the game is used, and a method in which a virtual currency referred to as "second game currency" in the game and being different from the first game currency is used, are prepared.

Here, the difference between the above two types of virtual currencies in the exemplary embodiment will be described. First, the first game currency is a virtual currency given to the user through payment processing using a currency in the real world. Meanwhile, as for the second game currency, the method for obtaining the second game currency is limited to the game world. For example, the second game currency can be obtained by selling an item in the game.

In this game, as the types of the lottery game, there are "first lottery game" and "second lottery game". The first lottery game is a lottery game that can be executed in exchange for the first game currency, and the second lottery game is a lottery game that can be executed in exchange for the second game currency. In the first lottery game, a "selling period" is set, and items (items that can be won) that can be obtained through the first lottery game include many items that are related to the selling period. For example, in a first lottery game in which the Christmas season is set as the selling period, a Christmas wreath, a Christmas tree, a candle, and the like are set as the lottery target item. Meanwhile, in the second lottery game, no selling period has been set, and items that can be obtained through the second lottery game include many items that can be used throughout the year. For example, in a second lottery game, a chest of drawers, a couch, and the like are set as the lottery target item. Each lottery game has a "concept", and items that suit the concept are set as the lottery target. For example, in a second lottery game of which the concept is "furniture article", items of furniture articles are set as the lottery target. In a first lottery game of which the concept is "Christmas", items related to Christmas are set as the lottery target. In a first lottery game of which the concept is "Halloween", items related to Halloween are set as the lottery target.

Figure 2:
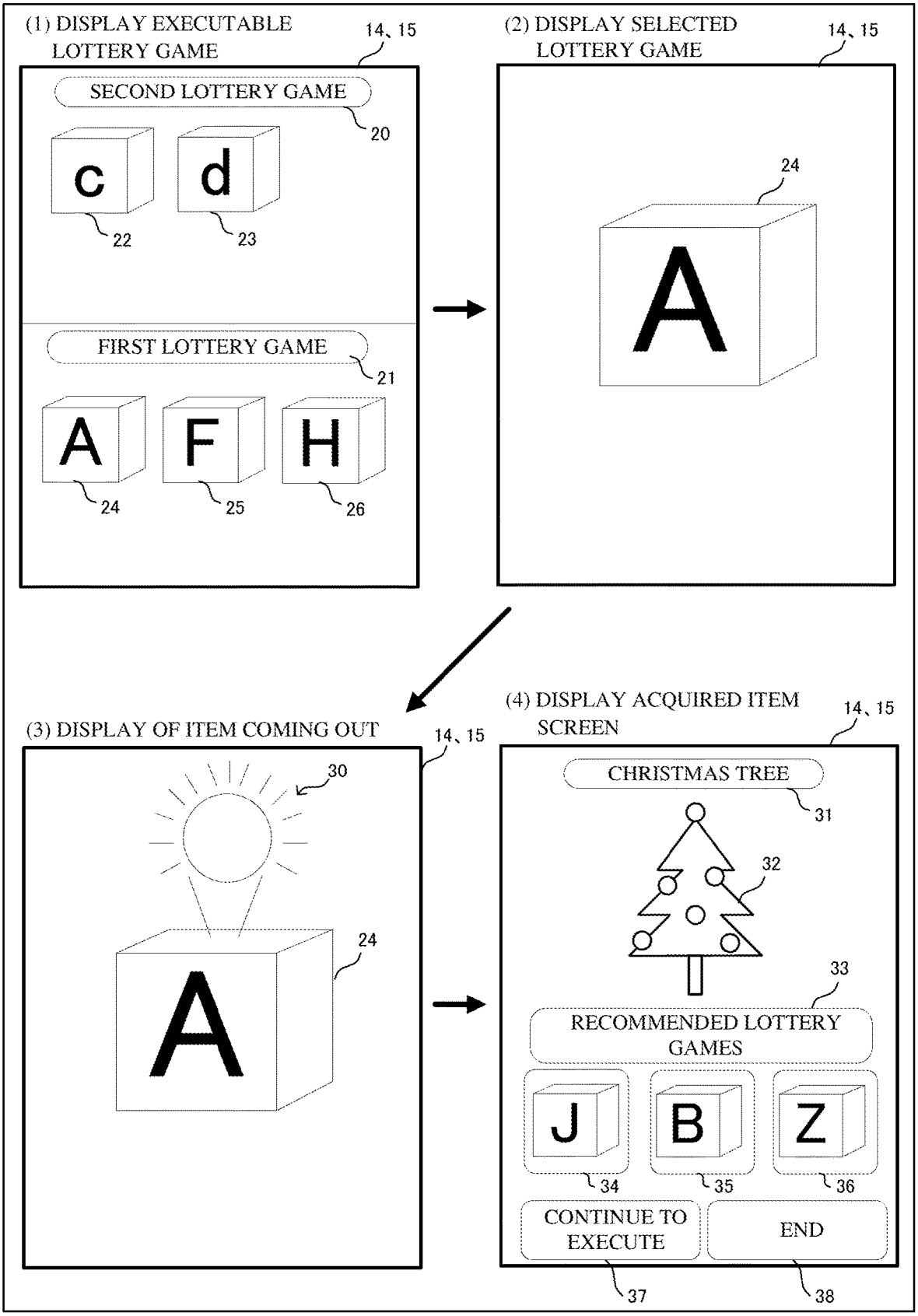
FIG. 2 shows a non-limiting example of a game screen.

FIG. 2 describes an example of transition of screens displayed when a lottery game has been executed and the user acquires an item determined through a lottery. In the following, specific description is given with reference to FIG. 2.

First, when the user performs a predetermined operation of displaying a lottery game executable in this game, a list of executable lottery games are displayed in a list as shown in (1) of FIG. 2. In (1) of FIG. 2, as an example, in the upper half of the screen, an image 20 rendered as "second lottery game", and second lottery games executable by the user are displayed, and in the lower half of the screen, an image 21 rendered as "first lottery game" and first lottery games executable by the user are displayed. In the exemplary embodiment, as an example, each lottery game is displayed in the form of an image of a cube. In each second lottery game, a lower-case alphabet letter is rendered, and in each first lottery game, an upper-case alphabet letter is rendered. In (1) of FIG. 2, as an example, an image 22 of a second lottery game rendered with "c", and an image 23 of a second lottery game rendered with "d" are displayed as the second lottery games executable by the user, and an image 24 of a first lottery game rendered with "A", an image 25 of a first lottery game rendered with "F", and an image 26 of a first lottery game rendered with "H" are displayed as the first lottery games executable by the user.

Then, when a lottery game that the user is to execute has been selected through a user operation (e.g., a tapping operation on the screen), the screen shifts (transitions) to a screen in which the selected lottery game is displayed in an enlarged manner as shown in (2) of FIG. 2. In (2) of FIG. 2, since the image 24 of a first lottery game rendered with "A" has been selected, the screen has shifted to a screen in which the image 24 of the first lottery game is displayed in an enlarged manner. Then, as shown in (3) of FIG. 2, the lottery game selected by the user is executed, and a representation display in which an item comes out is performed. In (3) of FIG. 2, as an example, a representation image 30 in which an item (an item selected through a lottery out of a plurality of items being the lottery target set in the first lottery game) comes out of the image 24 of the first lottery game rendered with the upper-case letter "A", is displayed. In (3) of FIG. 2, the representation image 30 is displayed in such a manner that which item has come out cannot be identified. However, in another exemplary embodiment, the representation image 30 may be displayed in such a manner that which item has come out can be identified.

Then, as shown in (4) of FIG. 2, an "acquired item screen" in which an image of the item (acquired item) obtained through the lottery as a result of the lottery game is displayed, is displayed as an example of a "lottery result display scene". In the exemplary embodiment, a "first image" is included in the acquired item screen. In (4) of FIG. 2, as an example of the first image, an image 31 of the name of the acquired item, and an image 32 of the acquired item are displayed. In another exemplary embodiment, as the first image, an image describing the acquired item may be displayed. In the exemplary embodiment, a "second image" is included in the acquired item screen. Then, as shown in (4) of FIG. 2, as an example of the second image, a maximum of three (a maximum of three frames of) thumbnail images (which may each be referred to as a "recommendation image") that each show a recommended first lottery game to be selected on the basis of a predetermined condition, may displayed.

Here, each of the lottery games (first lottery game and second lottery game) has set therein (is associated with) tag information indicating words (which may be words imaged from an item that can be acquired through the lottery game) imaged from the concept of the lottery game. For example, in a first lottery game of which the concept is Christmas, words such as "Christmas", "pleasant", "beautiful", "winter", and "family" are set as the tag information. For example, in a first lottery game of which the concept is Halloween, words such as "Halloween", "pleasant", "pumpkin", and "party" are set as the tag information. In the acquired item screen, a maximum of two recommendation images that each indicate, as a recommended first lottery game, a first lottery game (which may be referred to as "tag-conforming lottery game") that has set therein one or more pieces of tag information that is the same as the tag information set in the lottery game executed this time, may be displayed. In addition, in the acquired item screen, a maximum of two recommendation images that each indicate, as a recommended first lottery game, a first lottery game (which may be referred to as "non-tag-conforming lottery game") that has not set therein any tag information that is the same as the tag information set in the lottery game executed this time, may be displayed. In (4) of FIG. 2, as an example, an image 33 indicating "recommended lottery games", a recommendation image 34 of a first lottery game rendered with "J", a recommendation image 35 of a first lottery game rendered with "B", and a recommendation image 36 of a first lottery game rendered with "Z" are displayed.

Thus, in this game, in the acquired item screen, a first lottery game (tag-conforming lottery game) that is related to the lottery game executed this time may be recommended, and a first lottery game (non-tag-conforming lottery game) that is not related to the lottery game executed this time may be recommended. Accordingly, interest of the user can be directed to a first lottery game being a lottery game having a limited period, and not only a first lottery game related to the lottery game executed this time but also a first lottery game not related to the lottery game executed this time can be introduced. Therefore, diverse first lottery games can be introduced to the user.

Each first lottery game recommended in the acquired item screen is a lottery game different from the lottery game executed this time, and is a lottery game currently being in a selling period. In addition, the first lottery game recommended in the acquired item screen is a first lottery game excluding the first lottery games in which all of the items as the lottery target are possessed by the user.

Figure 3:
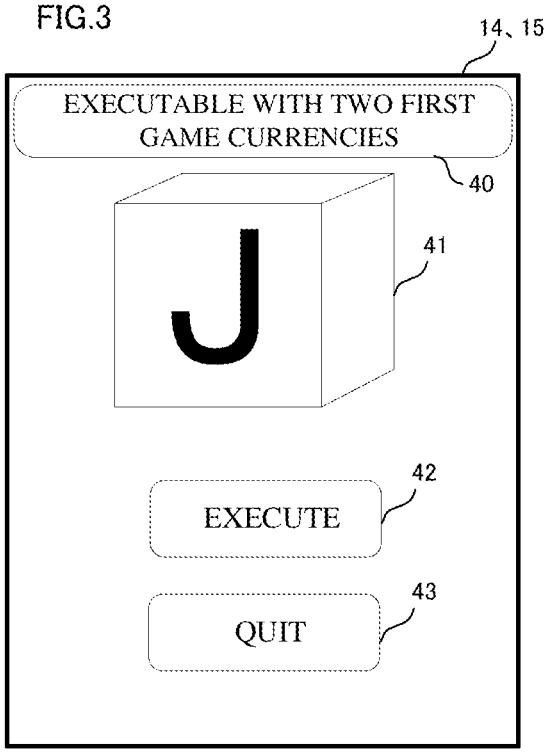
FIG. 3 shows a non-limiting example of a game screen.

Then, in the acquired item screen shown in (4) of FIG. 2, when a user operation (e.g., a tapping operation on the display position of a recommendation image showing a first lottery game) on any of the recommendation images showing recommended first lottery games has been performed, the screen shifts to an execution screen of the first lottery game according to the operated recommendation image. FIG. 3 shows an example of the execution screen of a recommended first lottery game. As shown in FIG. 3, in the execution screen of the recommended first lottery game, an image 41 of the first lottery game according to the recommendation image operated by the user in the acquired item screen, an image 40 indicating the number of first game currencies necessary for execution of the first lottery game, an image 42 of an "execute" button, and an image 43 of a "quit" button are displayed. FIG. 3 shows an execution screen in which the image 41 of the first lottery game rendered with "J" is displayed, after the recommendation image 34 indicating the first lottery game rendered with "J" in the acquired item screen shown in (4) of FIG. 2 has been selected.

In the execution screen (see FIG. 3) of the first lottery game, the user performs an operation (e.g., a tapping operation) on the image 42 of the "execute" button, thereby being able to execute the first lottery game displayed in the execution screen, by consuming the first game currency. Then, when the user has executed the first lottery game in the execution screen of the first lottery game, the first lottery game is displayed as a "selected lottery game" described with reference to (2) of FIG. 2. Then, screens having the contents described with reference to (3) and (4) of FIG. 2 are displayed, using the first lottery game as the target. That is, when an operation of executing the first lottery game is performed on the execution screen of the first lottery game shown in FIG. 3, the first lottery game is executed and an item acquired through a lottery is displayed, and, again, a recommendation image is selected and displayed. Meanwhile, in the execution screen (see FIG. 3) of the first lottery game, when the user has performed an operation (e.g., a tapping operation) on the image 43 of the "quit" button, the display returns to the display of the acquired item screen described with reference to (4) of FIG. 2.

Figure 4:
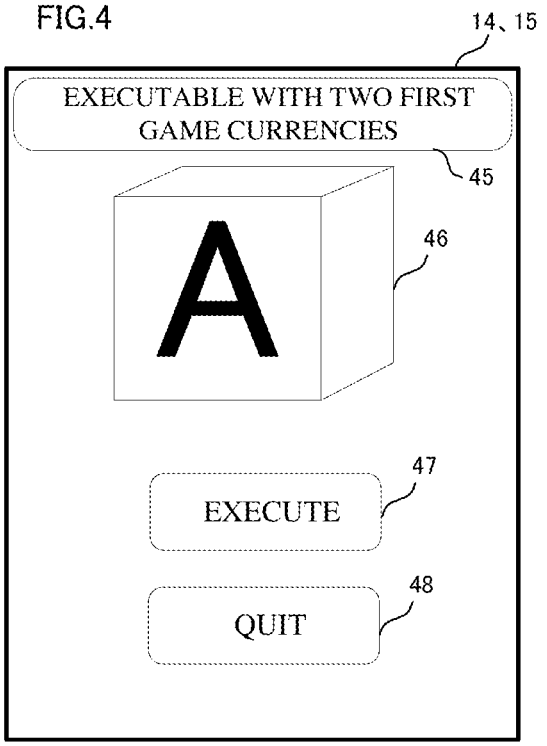
FIG. 4 shows a non-limiting example of a game screen.

When the user has performed an operation (e.g., a tapping operation) on an image 37 of a "continue to execute" button displayed in the acquired item screen shown in (4) of FIG. 2, the screen shifts to an execution screen of the same lottery game as that executed this time, as shown in FIG. 4. In the execution screen shown in FIG. 4, an image 46 of the same lottery game as that executed this time, an image 45 indicating the number of first game currencies necessary for execution of the lottery game, an image 47 of an "execute" button, and an image 48 of a "quit" button are displayed. In FIG. 4, as an example, an execution screen of the first lottery game (the lottery game executed this time) rendered with "A" which has been executed in FIG. 2 is displayed. In a case where the lottery game executed this time is a second lottery game, an execution screen of the second lottery game is displayed.

In the execution screen (see FIG. 4) of the same lottery game as that executed this time, the user performs an operation (e.g., a tapping operation) on the image 47 of the "execute" button, thereby being able to execute the lottery game displayed in the execution screen, by consuming the game currency (the first game currency or the second game currency). Then, when the user has executed the lottery game in the execution screen, the lottery game is displayed as a "selected lottery game" described with reference to (2) of FIG. 2. Then, screens having the contents described with reference to (3) and (4) of FIG. 2 are displayed, using the lottery game as the target. That is, when an operation (e.g., a tapping operation) is performed on the image 37 of the "continue to execute" button in the acquired item screen shown in (4) of FIG. 2, the same lottery game as that (see (3) of FIG. 2) executed this time can be executed again. In the execution screen of the lottery game (see FIG. 4), when the user has performed an operation (e.g., a tapping operation) on the image 48 of the "quit" button, the display returns to the display of the acquired item screen described with reference to (4) of FIG. 2.

[Detail of Information Processing of Exemplary Embodiment]

Next, with reference to FIG. 5 to FIG. 9, information processing in the exemplary embodiment will be described in detail.

[Data to be Used]

Figures 5, 6:
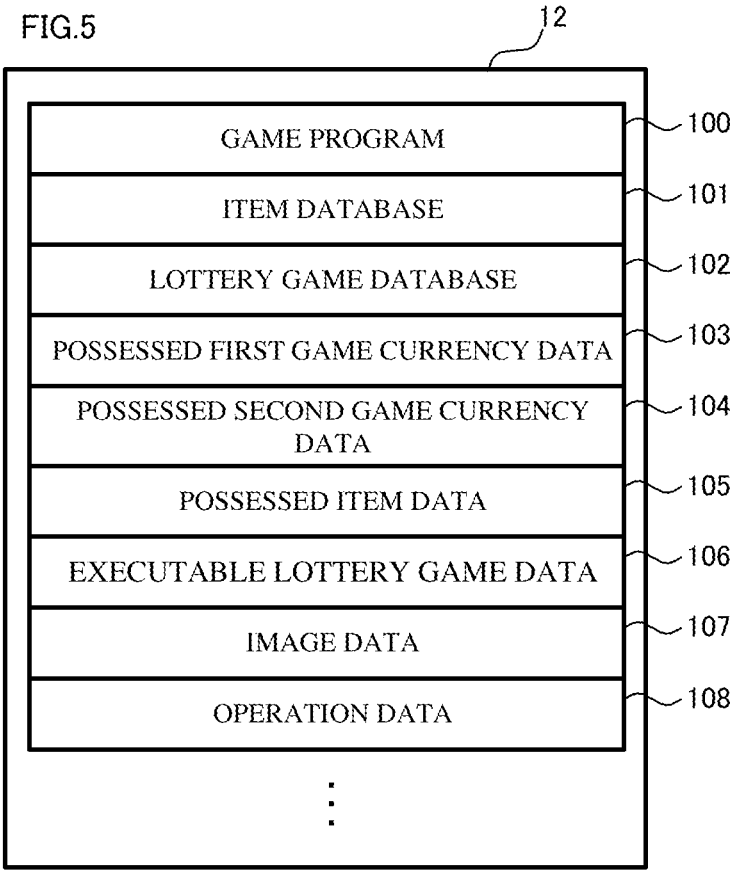
FIG. 5 is a non-limiting example of data and the like stored in a memory 12 of the information processing apparatus 10.
FIG. 6 is a non-limiting example of data and the like stored in the memory 12 of the information processing apparatus 10.

Various data to be used in this game process will be described. FIG. 5 shows an example of a program and data stored in the memory 12 of the information processing apparatus 10. The memory 12 stores therein a game program 100, an item database 101, a lottery game database 102, possessed first game currency data 103, possessed second game currency data 104, possessed item data 105, executable lottery game data 106, image data 107, operation data 108, and the like.

The game program 100 is a game program for executing the game process according to the exemplary embodiment.

The item database 101 is data that defines items. FIG. 6 shows an example of the data configuration of the item database 101. As shown in FIG. 6, the item database 101 includes item ID 201, item type data 202, and item content data 203.

The item ID 201 is an identifier for uniquely identifying each item.

The item type data 202 is data that defines the type of each item, and is data indicating the type of the item, such as items of furniture articles, items related to Christmas, or items related to Halloween, for example.

The item content data 203 is data that defines a specific content of each item, and includes information that defines the name and kind (e.g., desk, chair, chest of drawers) of the item, for example.

The lottery game database 102 is data that defines lottery games (first lottery game and second lottery game). FIG. 7 shows an example of the data configuration of the lottery game database 102. As shown in FIG. 7, the lottery game database 102 includes lottery game ID 211, lottery game type data 212, selling period data 213, lottery target item data 214, completion flag data 215, and recommendation tag data 216.

The lottery game ID 211 is an identifier for uniquely identifying each lottery game.

The lottery game type data 212 is data that defines whether the lottery game is a first lottery game or a second lottery game.

The selling period data 213 is data that defines a selling period (selling time) of the lottery game, and is data indicating December, for example.

The lottery target item data 214 is data that defines items (the item IDs 201 in the item database 101 shown in FIG. 6) that serve as the lottery target in the lottery game.

The completion flag data 215 is flag data indicating whether or not all of the items as the lottery target in the lottery game have been possessed. That is, the completion flag data 215 is flag data showing whether or not all of the items as the lottery target defined by the lottery target item data 214 have been possessed.

The recommendation tag data 216 is data of tag information indicating words (which may be words imaged from an item that can be acquired in the lottery game) imaged from the concept of the lottery game. For example, as shown in FIG. 7, in a case of a lottery game (see the lottery game ID "1000") of which the concept is Christmas, tag information such as "Christmas", "pleasant", "beautiful", "winter", and "family" are set as the recommendation tag data 216.

The possessed first game currency data 103 is data indicating the number of first game currencies possessed by the user.

The possessed second game currency data 104 is data indicating the number of second game currencies possessed by the user.

The possessed item data 105 is data indicating the item (the item ID 201 in the item database 101 shown in FIG. 6) possessed by the user.

The executable lottery game data 106 is data indicating lottery games (the lottery game IDs 211 in the lottery game database 102 shown in FIG. 7) executable by the user.

The image data 107 is image data of images of lottery games, images of items, and the like.

The operation data 108 is data indicating an operation performed on the information processing apparatus 10, and is data indicating an input operation to a touch panel, for example.

[Details of Game Process]

Figure 8:
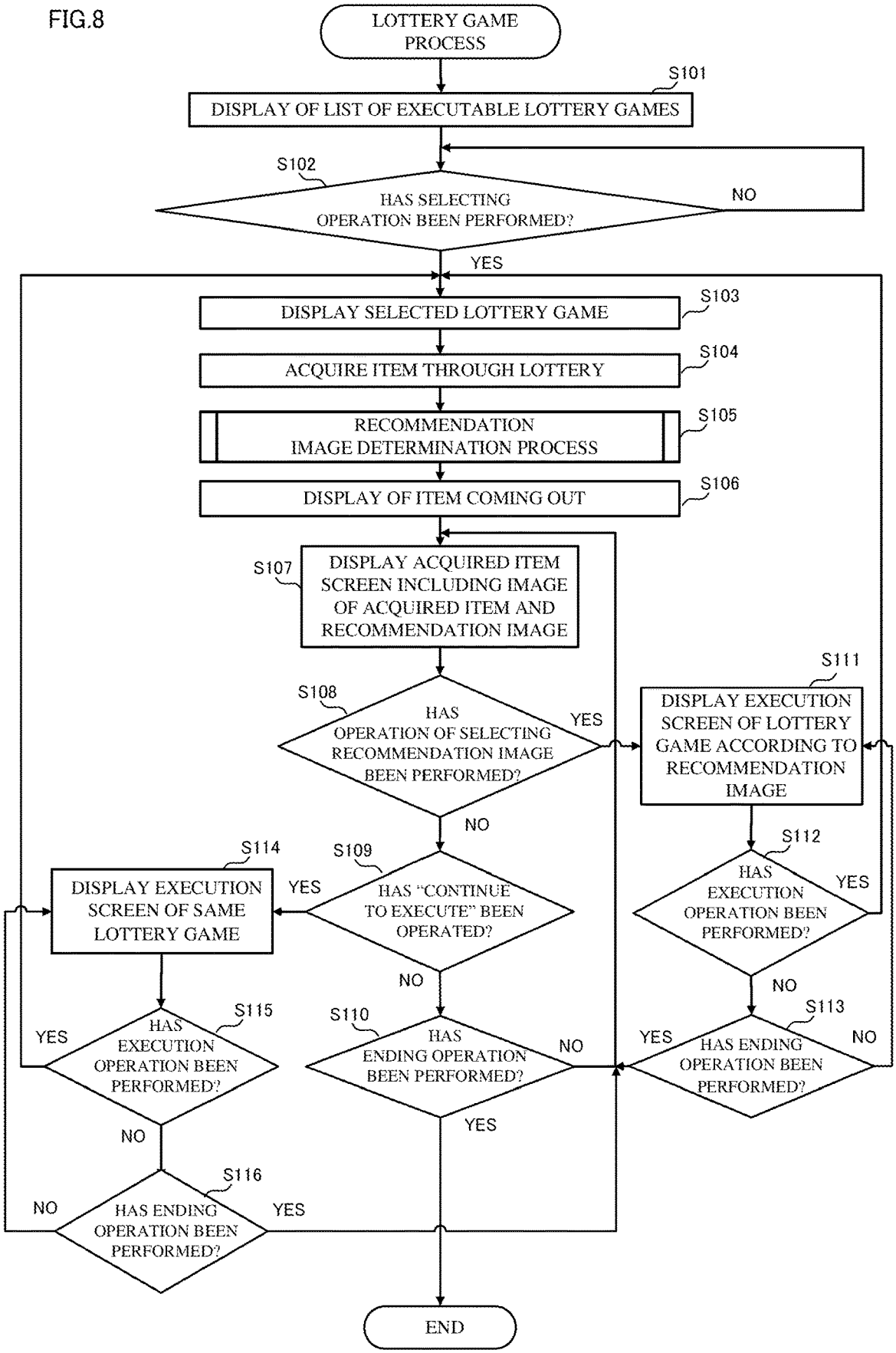
FIG. 8 is a non-limiting example of a flowchart showing details of a lottery game process.
Figure 9:
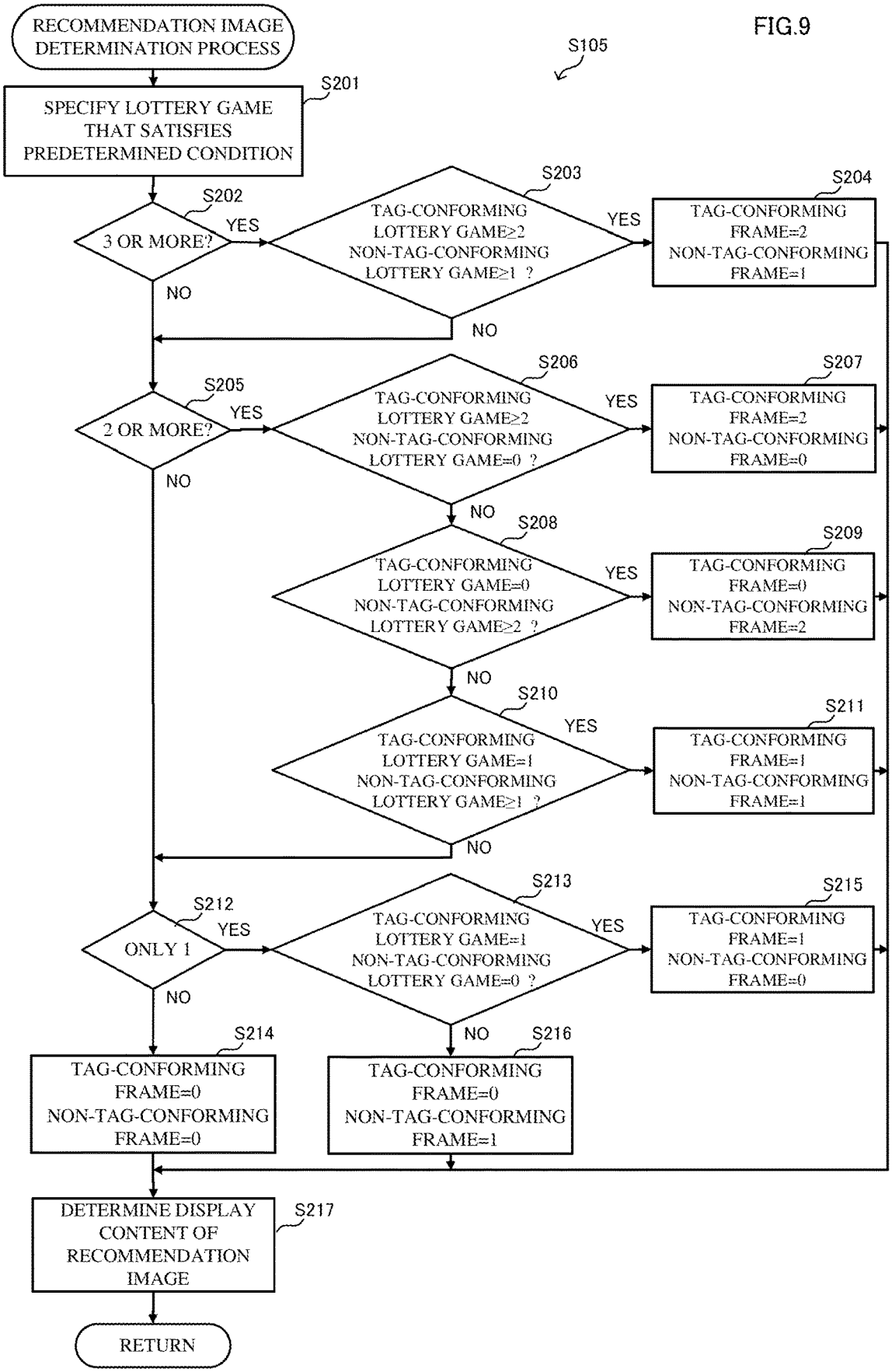
FIG. 9 is a non-limiting example of a flowchart showing details of a recommendation image determination process.

Next, with reference to a flowchart, details of the game process according to the exemplary embodiment will be described. FIG. 8 and FIG. 9 are each an example of a flowchart showing details of the game process according to the exemplary embodiment.

The lottery game process shown in FIG. 8 is started when a predetermined operation of displaying a list of executable lottery games has been performed by the user.

In step S101, the processor 11 displays a list of executable lottery games. Specifically, with reference to the executable lottery game data 106 shown in FIG. 5, the processor 11 causes the display section 15 to display a list of lottery games executable by the user as described with reference to (1) of FIG. 2. Then, the process proceeds to step S102.

In step S102, the processor 11 waits (NO) until an operation (e.g., a tapping operation) of selecting any of the executable lottery games displayed in step S101 is performed by the user, and when the selecting operation has been performed (YES), the process proceeds to step S103.

In step S103, the processor 11 displays the lottery game selected in step S102. Specifically, as described with reference to (2) of FIG. 2, the processor 11 causes the display section 15 to display the lottery game selected in step S102. Then, the process proceeds to step S104.

In step S104, the processor 11 determines an item to be acquired, through a lottery. Specifically, the processor 11 determines an item to be acquired through a lottery out of the items set as the lottery target in the lottery game selected in step S102. More specifically, by using the lottery game database 102 described with reference to FIG. 7, the processor 11 determines an item to be acquired through a predetermined lottery (e.g., a lottery in which winning probabilities are equal) out of a plurality of items indicated by the lottery target item data 214 that corresponds to the lottery game (the lottery game ID 211) selected in step S102. Then, the process proceeds to step S105.

In step S105, the processor 11 performs a recommendation image determination process. FIG. 9 is an example of the flowchart of the recommendation image determination process of step S105 in FIG. 8. In the following, with reference to FIG. 9, the recommendation image determination process of step S105 in FIG. 8 will be described.

In step S201 in FIG. 9, the processor 11 specifies a lottery game that satisfies a predetermined condition. Specifically, the processor 11 performs a process of specifying each lottery game that is a lottery game other than the lottery game selected this time in step S102 in FIG. 8, that is a first lottery game in a selling period, and that is not a lottery game in which all of the items as the lottery target are possessed by the user (the items are all completed). This process is performed by using the lottery game type data 212, the selling period data 213, the lottery target item data 214, the completion flag data 215 (see FIG. 7), and the like. Then, the process proceeds to step S202.

In step S202, the processor 11 determines whether or not the number of lottery games specified in step S201 is three or more. When the determination in step S202 is YES, the process proceeds to step S203, and when this determination is NO, the process proceeds to step S205.

In step S203, the processor 11 determines whether the lottery games specified in step S201 include two or more of the above-described "tag-conforming lottery game" and include one or more of the above-described "non-tag-conforming lottery game". Specifically, the processor 11 determines whether the lottery games specified in step S201 include: two or more first lottery games (i.e., tag-conforming lottery games) that each have set therein one or more pieces of tag information (which may be referred to as "conforming tag") that is the same as the tag information set in the lottery game selected in step S102 in FIG. 8; and one or more first lottery games (i.e., non-tag-conforming lottery games) that each do not have set therein any tag information that is the same as the tag information set in the lottery game selected in step S102 in FIG. 8. This process is performed by using the recommendation tag data 216 (see FIG. 7). When the determination in step S203 is YES, the process proceeds to step S204, and when this determination is NO, the process proceeds to step S205.

In step S204, the processor 11 determines the number of "tag-conforming frames (tag-conforming regions)" for displaying recommendation images of the tag-conforming lottery games in the acquired item screen (see (4) of FIG. 2), to be two, and determines the number of "non-tag-conforming frames (non-tag-conforming regions)" for displaying recommendation images of the non-tag-conforming lottery games in the acquired item screen, to be one. Then, the process proceeds to step S217.

In step S205, the processor 11 determines whether or not the number of lottery games specified in step S201 is two or more. When the determination in step S205 is YES, the process proceeds to step S206, and when this determination is NO, the process proceeds to step S212.

In step S206, the processor 11 performs a process of determining, by the same method as in step S203, whether the lottery games specified in step S201 include two or more tag-conforming lottery games and do not include any non-tag-conforming lottery game (i.e., 0). When the determination in step S206 is YES, the process proceeds to step S207, and when this determination is NO, the process proceeds to step S208.

In step S207 the processor 11 determines the number of tag-conforming frames to be two, and determines the number of non-tag-conforming frames to be 0. Then, the process proceeds to step S217.

In step S208, the processor 11 performs a process of determining, by the same method as in step S203, whether the lottery games specified in step S201 do not include any tag-conforming lottery game (i.e., 0) and include two or more non-tag-conforming lottery games. When the determination in step S208 is YES, the process proceeds to step S209, and when this determination is NO, the process proceeds to step S210.

In step S209, the processor 11 determines the number of tag-conforming frames to be 0, and determines the number of non-tag-conforming frames to be two. Then, the process proceeds to step S217.

In step S210, the processor 11 performs a process of determining, by the same method as in step S203, whether the lottery games specified in step S201 include one tag-conforming lottery game and include one or more non-tag-conforming lottery games. When the determination in step S210 is YES, the process proceeds to step S211, and when this determination is NO, the process proceeds to step S212.

In step S211, the processor 11 determines the number of tag-conforming frames to be one, and determines the number of non-tag-conforming frames to be one. Then, the process proceeds to step S217.

In step S212, the processor 11 determines whether or not the number of lottery games specified in step S201 is only one. When the determination in step S212 is YES, the process proceeds to step S213, and when this determination is NO, the process proceeds to step S214.

In step S213, the processor 11 performs a process of determining, by the same method as in step S203, whether the lottery games specified in step S201 include one tag-conforming lottery game and do not include any non-tag-conforming lottery game (i.e., 0). When the determination in step S213 is YES, the process proceeds to step S215, and this determination is NO, the process proceeds to step S216.

In step S215, the processor 11 determines the number of tag-conforming frames to be one, and determines the number of non-tag-conforming frames to be 0. Then, the process proceeds to step S217.

In step S216, the processor 11 determines the number of tag-conforming frames to be 0, and determines the number of non-tag-conforming frames to be one. Then, the process proceeds to step S217.

In step S214, the processor 11 determines the number of tag-conforming frames to be 0, and determines the number of non-tag-conforming frames to be 0. Then, the process proceeds to step S217.

In step S217, the processor 11 determines through a lottery a display content of the recommendation image to be displayed in the acquired item screen (see (4) of FIG. 2). Specifically, when the number of tag-conforming frames has been determined to be one or two in step S204, S207, S209, S211, S215, or S216, the processor 11 determines a recommendation image (recommendation image that recommends a tag-conforming lottery game) to be displayed in the tag-conforming frame, by a lottery method (i.e., a lottery method in which the larger the number of conforming tags, the easier to be selected) in which the larger number of conforming tags a tag-conforming lottery game has, the higher the probability of being selected is. Accordingly, a tag-conforming lottery game that has a larger number of conforming tags is more likely to be recommended by the recommendation image to the user. When the number of non-tag-conforming frames has been determined to be one or two in step S204, S207, S209, S211, S215, or S216, a recommendation image (a recommendation image that recommends a non-tag-conforming lottery game) to be displayed in the non-tag-conforming frame is determined through a lottery in which the probabilities of being selected are equal. Accordingly, a non-tag-conforming lottery game of which the number of conforming tags is 0 is recommended by the recommendation image to the user. When the number of tag-conforming frames has been determined to be 0 and the number of non-tag-conforming frames has been determined to be 0 in step S214, it is determined that no recommendation image is displayed. In this manner, in accordance with the numbers of tag-conforming frames and non-tag-conforming frames determined in step S204, S207, S209, S211, S214, S215, or S216, recommendation images of the tag-conforming lottery game and the non-tag-conforming lottery game are displayed in the acquired item screen. Then, the process proceeds to step S106 in FIG. 8.

In step S106 in FIG. 8, as described with reference to (3) of FIG. 2, the processor 11 performs a representation display in which an item comes out of the image of the lottery game displayed in step S103. In addition, the lottery game displayed in step S103 is deleted from the executable lottery game data 106. Then, the process proceeds to step S107.

In step S107, the processor 11 causes the display section 15 to display an acquired item screen (see (4) of FIG. 2) that includes the image of the acquired item determined through the lottery in step S104 and the recommendation image determined in step S217 in FIG. 9. At that time, when a plurality of recommendation images are to be displayed, the processor 11 determines the display positions (display frames) of the recommendation images through a lottery in which the probabilities of being elected are equal, for example, and causes the recommendation images to be displayed. Then, the process proceeds to step S108.

In step S108, as described with reference to (4) of FIG. 2, the processor 11 determines whether or not a user operation (e.g., a tapping operation) of selecting a recommendation image displayed in the acquired item screen displayed in step S107 has been performed. When the determination in step S108 is YES, the process proceeds to step S111, and when this determination is NO, the process proceeds to step S109.

In step S111, as described with reference to (4) of FIG. 2 and FIG. 3, the processor 11 causes the display section 15 to display an execution screen of the lottery game indicated by the recommendation image selected in step S108. Then, the process proceeds to step S112.

In step S112, the processor 11 determines whether or not an execution operation by the user has been performed in the execution screen displayed in step S111. Specifically, the processor 11 determines whether or not an operation (e.g., a tapping operation) has been performed on the image 42 rendered as "execute" in FIG. 3. When the determination in step S112 is YES, the process returns to step S103, and when this determination is NO, the process proceeds to step S113. Here, when the process has returned to step S103, the lottery game according to the recommendation image on which the execution operation has been performed is displayed as a "selected lottery game" in step S103. When the execution operation has been performed in step S112, the processor 11 subtracts the number of game currencies (the first game currency) necessary for the execution, thereby updating the possessed first game currency data 103, and adds the first lottery game for which the execution operation has been performed, to the executable lottery game data 106.

In step S113, the processor 11 determines whether or not an ending operation of the execution screen displayed in step S111 has been performed. Specifically, the processor 11 determines whether or not an operation (e.g., a tapping operation) has been performed on the image 43 rendered as "quit" shown in FIG. 3. When the determination in step S113 is YES, the process returns to step S107 to display the acquired item screen (see (4) of FIG. 2), and when this determination is NO, the process returns to step S111 to continue display of the execution screen.

In step S109, as described with reference to (4) of FIG. 2, the processor 11 determines whether or not a user operation (e.g., a tapping operation) has been performed on the image 37 rendered as "continue to execute" displayed in the acquired item screen displayed in step S107. When the determination in step S109 is YES, the process proceeds to step S114, and when this determination is NO, the process proceeds to step S110.

In step S114, as described with reference to (4) of FIG. 2 and FIG. 4, the processor 11 causes the display section 15 to display an execution screen of the same lottery game as that selected this time in step S102. Then, the process proceeds to step S115.

In step S115, the processor 11 determines whether or not an execution operation by the user has been performed in the execution screen displayed in step S114. Specifically, the processor 11 determines whether or not an operation (e.g., a tapping operation) has been performed on the image 47 rendered as "execute" shown in FIG. 4. When the determination in step S115 is YES, the process returns to step S103, and when this determination is NO, the process proceeds to step S116. Here, when the process has returned to step S103, the lottery game for which the execution operation has been performed is displayed as a "selected lottery game" in step S103. When the execution operation has been performed in step S115, the processor 11 subtracts the number of game currencies (the first game currency or the second game currency) necessary for the execution, thereby updating the possessed first game currency data 103 or the possessed second game currency data 104, and adds the lottery game for which the execution operation has been performed, to the executable lottery game data 106.

In step S116, the processor 11 determines whether or not an ending operation of the execution screen displayed in step S114 has been performed. Specifically, the processor 11 determines whether or not an operation (e.g., a tapping operation) has been performed on the image 48 rendered as "quit" shown in FIG. 4. When the determination in step S116 is YES, the process returns to step S107 to display the acquired item screen (see (4) of FIG. 2), and when this determination is NO, the process returns to step S114 to continue display of the execution screen.

In step S110, the processor 11 determines whether or not an ending operation of the acquired item screen displayed in step S107 has been performed. Specifically, the processor 11 determines whether or not an operation (e.g., a tapping operation) has been performed on an image 38 rendered as "end" shown in (4) of FIG. 2. When the determination in step S110 is YES, the lottery game process in FIG. 8 ends, and when this determination is NO, the process returns to step S107 to continue display of the acquired item screen.

This is the end of description of the lottery game process. In the exemplary embodiment, when the application of this game is to be started, various kinds of data (see FIG. 5) are obtained from a game server (not shown) (through wireless communication or wired communication via the Internet or the like), to be read into various data in the memory 12, thereby executing the game. When the application of this game is to be ended, various kinds of data (saved data, etc.) are saved in the game server. In another exemplary embodiment, data necessary in the game process may be communicated as appropriate with the game server, to execute this game.

The "item" described above is an example of the "content". The lottery game recommended by the "recommendation image" described above is an example of a "recommended lottery game". The "acquired item screen" described above is an example of a "lottery result display scene". The "first game currency" described above is an example of a "paid item".

As described above, in the exemplary embodiment, when an item acquired through a lottery by executing a lottery game is displayed, a recommendation image that recommends another lottery game different from the lottery game executed this time is displayed (see (4) FIG. 2). Accordingly, it is possible to notify the user of what other lottery games are present, to enhance interest of the user in the lottery game.

Further, in the exemplary embodiment, when an item acquired through a lottery by executing a lottery game is displayed, a recommendation image that recommends a lottery game (tag-conforming lottery game) related to the lottery game executed this time is displayed (see FIG. 9, etc.). Accordingly, a lottery game in which the user has high interest can be presented.

Further, in the exemplary embodiment, when an item acquired through a lottery by executing a lottery game is displayed, a recommendation image that recommends a lottery game (non-tag-conforming lottery game) not related to the lottery game executed this time is displayed (see FIG. 9). Accordingly, diversity of the lottery game presented to the user can be enhanced.

Further, in the exemplary embodiment, when an item acquired through a lottery by executing a lottery game is displayed, a recommendation image that recommends a first lottery game (i.e., a lottery game that can be executed only in a selling period) in which a selling period is set is displayed (see (4) of FIG. 2). Accordingly, occurrence of a situation where the user cannot execute the lottery game because the selling period has elapsed can be suppressed.

Further, in the exemplary embodiment, a lottery game (recommendation image) to be recommended is determined on the basis of tag information. Therefore, when a lottery game has been added, for example, (there is no need to perform setting, etc. for the existing lottery games) it is sufficient to set tag information in the lottery game having been added, for example. Thus, work efficiency is enhanced.

[Modification]

The above exemplary embodiment has shown the example in which a recommendation image to be displayed in a tag-conforming frame is determined by a lottery method in which the larger the number of conforming tags is, the easier to be selected (see description of S217 in FIG. 9). However, for example, without performing a lottery, a tag-conforming lottery game having a large number of conforming tags may be recommended in preference by a recommendation image to the user. For example, when the number of tag-conforming frames is two, a tag-conforming lottery game having the largest number of conforming tags and a tag-conforming lottery game having the second largest number of conforming tags may be recommended by recommendation images to the user.

The above exemplary embodiment has shown the example in which, when an operation has been performed on a recommendation image in the acquired item screen, the screen shifts to an execution screen of the lottery game according to the recommendation image (see (4) of FIG. 2 and FIG. 3). However, for example, when an operation has been performed on a recommendation image in the acquired item screen, the screen may shift to a screen that describes a lottery game according to the recommendation image, and then shift to the execution screen. In addition, for example, an image that describes a recommended lottery game may be displayed in an execution screen (see FIG. 3) of a lottery game.

The above exemplary embodiment has shown the example in which, when an operation has been performed on a recommendation image in the acquired item screen, the screen shifts once to an execution screen, and then, a lottery game is executed in accordance with a user operation in the execution screen (see (4) of FIG. 2 and FIG. 3). However, for example, when an operation has been performed on a recommendation image in the acquired item screen, a lottery game according to the recommendation image may be executed (without displaying an execution screen).

In the above exemplary embodiment, between a plurality of lottery games, at least a part of the items as the lottery targets may be the same. That is, the same item may be won in different lottery games.

The above exemplary embodiment has shown the example in which tag information indicates words. However, for example, the tag information may be information that indicates a lottery game to be related thereto (to be associated therewith).

The above exemplary embodiment has shown the example in which the number of recommendation images to be displayed in the acquired item screen (see (4) of FIG. 2) and lottery games to be recommended by the recommendation images are determined on the basis of whether or not the tag information is the same (see S203, etc., in FIG. 9). However, for example, the number of recommendation images to be displayed in the acquired item screen and lottery games to be recommended by the recommendation images may be determined on the basis of whether or not the tag information is the same or similar. Accordingly, there is no need to set accurate tag information, and thus, work of setting tag information is reduced, and a lottery game having a relatively low relevance can also be presented to the user.

The above exemplary embodiment has shown the example in which, when an execution operation of a lottery game has been performed on an execution screen (see FIG. 3 and FIG. 4), an image of the lottery game is immediately displayed and the lottery game is executed (see FIG. 8). However, for example, when an execution operation of a lottery game has been performed on an execution screen (se FIG. 3 and FIG. 4), the screen may shift once to a screen in which a list of executable lottery games is displayed (see (1) of FIG. 2) and the lottery game for which the execution operation has been performed is additionally displayed, and then, the lottery game for which the execution operation has been performed may be executed (e.g., automatically).

In the above exemplary embodiment, as a result of execution of one lottery game, a plurality of items may be won.

In the above exemplary embodiment, an image (an image of a lottery game, an image of an item, a recommendation image, etc.) to be displayed may be an image that displays a character string.

In the above exemplary embodiment, immediately below each recommendation image (see (4) of FIG. 2), an image indicating "execute this lottery game" may be displayed, and when a tapping operation is performed on this image by the user, the screen may shift to an execution screen.

In the above exemplary embodiment, the acquired item screen described with reference to (4) of FIG. 2 may consist of a plurality of screens (scenes). For example, an acquired item is displayed, and when a tapping operation is performed on the item by the user, a recommendation image may be additionally displayed, the display may be switched to a display of a recommendation image, or a recommendation image may be displayed in another screen by means of a pop-up window.

The above exemplary embodiment has shown the example in which a selling period is set in the first lottery game and no selling period is set in the second lottery game. However, for example, the first lottery game may include a lottery game in which no selling period is set. In addition, the second lottery game may include a lottery game in which a selling period is set.

The above exemplary embodiment has shown the example in which, when a user operation has been performed on a recommendation image or the "continue to execute" button in the acquired item screen (see (4) of FIG. 2), the screen shifts to an execution screen of a lottery game (see FIG. 3 and FIG. 4). However, for example, when a user operation has been performed on a recommendation image or the "continue to execute" button in the acquired item screen (see (4) of FIG. 2), the screen may shift to an obtainment screen (not shown) of a lottery game corresponding to the user operation, and when a user operation of obtaining the lottery game has been performed in the obtainment screen, the screen may shift to an execution screen of the lottery game (see FIG. 3 and FIG. 4). That is, the screen may shift to the execution screen through the obtainment screen. In this case, for example, an image indicating the number of game currencies necessary for obtaining the lottery game is displayed on the obtainment screen, whereas an image (40, 45) indicating the number of game currencies necessary for execution of the lottery game is not displayed in the execution screen.

The above exemplary embodiment has shown the example in which a series of processing steps in the game process is executed by a single apparatus. However, the above series of processing steps may be executed by an information processing system including a plurality of information processing apparatuses. For example, in an information processing system including a terminal-side apparatus and a server-side apparatus capable of communicating with the terminal-side apparatus via a network, a part of the above series of processing steps may be executed by the server-side apparatus. Further, in an information processing system including a terminal-side apparatus and a server-side apparatus capable of communicating with the terminal-side apparatus via a network, major processing of the above series of processing steps may be executed by the server-side apparatus, and a part of the above series of processing steps may be executed by the terminal-side apparatus. In addition, in the above information processing system, a server-side system may be composed of a plurality of information processing apparatuses and processing to be executed on the server side may be executed by the plurality of information processing apparatuses in a shared manner.

While the exemplary embodiment has been described herein, it is to be understood that the above description is, in all aspects, merely an illustrative example, and is not intended to limit the scope thereof. It is to be understood that various modifications and variations can be made without deviating from the scope of the exemplary embodiment.

What is claimed is:

1. A computer-readable non-transitory storage medium having stored therein instructions that, when executed by a processor of an information processing apparatus, cause the information processing apparatus to:

select, on the basis of a user operation, at least one lottery game out of a plurality of lottery games in each of which a plurality of contents are set as a lottery target;

specify, on the basis of a lottery, at least one content out of the plurality of contents set as the lottery target in the selected lottery game;

specify, as a recommended lottery game, a lottery game selected on the basis of a predetermined condition out of lottery games that are different from the selected lottery game among the plurality of lottery games;

cause a display device to display, in a lottery result display scene, at least a first image regarding the specified content and a second image regarding the specified recommended lottery game; and cause, when a user operation on the second image has been performed in the lottery result display scene, the lottery result display scene to transition to a scene for the recommended lottery game regarding the second image.

2. The storage medium according to claim 1, wherein the instructions cause the information processing apparatus to specify, as the recommended lottery game, at least one lottery game associated in advance with the selected lottery game out of the lottery games that are different from the selected lottery game.

3. The storage medium according to claim 1, wherein the instructions cause the information processing apparatus to specify, as the recommended lottery game, at least one lottery game associated in advance with the selected lottery game, and/or a lottery game not associated in advance with the selected lottery game, out of the lottery games that are different from the selected lottery game.

4. The storage medium according to claim 2, wherein each of the plurality of lottery games has stored therein in advance at least one piece of tag information so as to correspond thereto, and the instructions cause the information processing apparatus to specify, as the recommended lottery game, at least one lottery game that has stored therein so as to correspond thereto tag information related to the tag information stored so as to correspond to the selected lottery game, out of the lottery games that are different from the selected lottery game.

5. The storage medium according to claim 4, wherein when there are a plurality of lottery games that have stored therein so as to correspond thereto tag information related to the tag information stored so as to correspond to the selected lottery game, the instructions cause the information processing apparatus to specify, on the basis of the number of pieces of the related tag information, the recommended lottery game out of said plurality of lottery games that have stored therein so as to correspond thereto tag information related to the tag information stored so as to correspond to the selected lottery game.

6. The storage medium according to claim 1, wherein the instructions cause the information processing apparatus to specify, as the recommended lottery game, lottery games in a number determined on the basis of a condition different from the predetermined condition out of the lottery games that are different from the selected lottery game among the plurality of lottery games.

7. The storage medium according to claim 6, wherein the instructions cause the information processing apparatus to specify, as the recommended lottery game, lottery games in a number determined at least on the basis of the number of lottery games currently selectable by a user, out of the plurality of lottery games.

8. The storage medium according to claim 1, wherein the instructions cause the information processing apparatus to:

select, on the basis of a user operation, at least one lottery game out of a plurality of first lottery games each executable in exchange for consumption of a paid item and a plurality of second lottery games each executable without consumption of a paid item; and specify, as the recommended lottery game, a lottery game selected on the basis of the predetermined condition out of the plurality of first lottery games.

9. The storage medium according to claim 1, wherein the instructions cause the information processing apparatus to cause the display device to display the lottery result display scene that includes a third image, and when a user operation on the third image has been performed in the lottery result display scene, cause the lottery result display scene to transition to a scene for the selected lottery game.

10. The storage medium according to claim 1, wherein the instructions cause the information processing apparatus to cause a storage device to store a content possessed by a user, as a possessed content, and exclude a lottery game in which all of a plurality of contents set as a lottery target are stored as the possessed content, from a target to be specified as the recommended lottery game.

11. The storage medium according to claim 1, wherein the instructions cause the information processing apparatus to after transition to the scene for the recommended lottery game has been performed, specify, as the recommended lottery game, a lottery game selected on the basis of the predetermined condition out of lottery games that are different from the recommended lottery game among the plurality of lottery games.

12. An information processing system comprising:

a processor and a memory coupled thereto, the processor being configured to control the information processing system to at least:

select, on the basis of a user operation, at least one lottery game out of a plurality of lottery games in each of which a plurality of contents are set as a lottery target;

specify, on the basis of a lottery, at least one content out of the plurality of contents set as the lottery target in the selected lottery game;

specify, as a recommended lottery game, a lottery game selected on the basis of a predetermined condition out of lottery games that are different from the selected lottery game among the plurality of lottery games;

display, in a lottery result display scene, at least a first image regarding the specified content and a second image regarding the specified recommended lottery game; and cause, when a user operation on the second image has been performed in the lottery result display scene, the lottery result display scene to transition to a scene for the recommended lottery game regarding the second image.

13. An information processing method executed by a processor configured to control an information processing system, the information processing method causing the information processing system to:

select, on the basis of a user operation, at least one lottery game out of a plurality of lottery games in each of which a plurality of contents are set as a lottery target;

specify, on the basis of a lottery, at least one content out of the plurality of contents set as the lottery target in the selected lottery game;

specify, as a recommended lottery game, a lottery game selected on the basis of a predetermined condition out of lottery games that are different from the selected lottery game among the plurality of lottery games;

display, in a lottery result display scene, at least a first image regarding the specified content and a second image regarding the specified recommended lottery game; and cause, when a user operation on the second image has been performed in the lottery result display scene, the lottery result display scene to transition to a scene for the recommended lottery game regarding the second image.

14. An information processing apparatus comprising:

a processor and a memory coupled thereto, the processor being configured to control the information processing apparatus to at least:

select, on the basis of a user operation, at least one lottery game out of a plurality of lottery games in each of which a plurality of contents are set as a lottery target;

specify, on the basis of a lottery, at least one content out of the plurality of contents set as the lottery target in the selected lottery game;

specify, as a recommended lottery game, a lottery game selected on the basis of a predetermined condition out of lottery games that are different from the selected lottery game among the plurality of lottery games;

display, in a lottery result display scene, at least a first image regarding the specified content and a second image regarding the specified recommended lottery game; and cause, when a user operation on the second image has been performed in the lottery result display scene, the lottery result display scene to transition to a scene for the recommended lottery game regarding the second image.

* * * * *